US008347773B2

(12) United States Patent
Schlenkert et al.

(10) Patent No.: US 8,347,773 B2
(45) Date of Patent: Jan. 8, 2013

(54) THERMAL INSULATION JACKET FOR A GUN BARREL

(75) Inventors: Gert Schlenkert, Düsseldorf (DE); Eckehard Bohnsack, Hermannsburg (DE); Alexander Tekin, Celle (DE)

(73) Assignee: Rheinmetall Waffe Munition GmbH, Unterlub (DE)

( * ) Notice: Subject to any disclaimer, the term of this patent is extended or adjusted under 35 U.S.C. 154(b) by 312 days.

(21) Appl. No.: 12/290,808

(22) Filed: Nov. 4, 2008

(65) Prior Publication Data

US 2011/0100204 A1 May 5, 2011

(30) Foreign Application Priority Data

Nov. 9, 2007 (DE) ..... 10 2007 053 949

(51) Int. Cl.
*F41A 13/12* (2006.01)

(52) U.S. Cl. ..... 89/14.1

(58) Field of Classification Search ..... 42/76.01, 42/76.02, 77; 89/14.1
See application file for complete search history.

(56) References Cited

U.S. PATENT DOCUMENTS

| | | | | | |
|---|---|---|---|---|---|
| 2,674,822 | A * | 4/1954 | Studler | ..... | 42/71.01 |
| 2,965,994 | A * | 12/1960 | Sullivan | ..... | 42/71.01 |
| 3,367,054 | A * | 2/1968 | Loffler et al. | ..... | 42/71.01 |
| 4,424,734 | A | 1/1984 | Janssen et al. | | |
| 4,663,875 | A * | 5/1987 | Tatro | ..... | 42/71.01 |
| 4,762,048 | A | 8/1988 | Higashi et al. | | |
| 5,062,346 | A * | 11/1991 | Hansen et al. | ..... | 89/14.1 |
| 5,400,691 | A | 3/1995 | Suttie et al. | | |
| 6,314,857 | B1 * | 11/2001 | Schmidt et al. | ..... | 89/14.1 |
| 6,701,742 | B2 * | 3/2004 | Mack et al. | ..... | 62/430 |

FOREIGN PATENT DOCUMENTS

| | | |
|---|---|---|
| CA | 2616472 | 2/2007 |
| DE | 4400512 A | 7/1994 |
| DE | 19904417 A | 8/2000 |
| EP | 0033770 A | 8/1981 |
| WO | 2007017226 A | 2/2007 |

* cited by examiner

*Primary Examiner* — Michael Carone
*Assistant Examiner* — Reginald Tillman, Jr.
(74) *Attorney, Agent, or Firm* — Lucas & Mercanti, LLP; Klaus P. Stoffel

(57) ABSTRACT

A thermal insulation jacket for a gun barrel, especially a cannon barrel, where the thermal insulation jacket includes a metal jacket that surrounds the gun barrel. In order to prevent uneven heating of the surface of the gun barrel within the thermal insulation jacket, an additional area that is especially effective at reflecting thermal radiation is provided on the inner surface of the metal jacket that lies opposite the underside of the gun barrel, so that when the gun barrel heats, the temperature differences between the upper side and the underside of the gun barrel are at least partially compensated. For this purpose, a reflective film is provided as the area that is a good reflector of thermal radiation. This reflective film is adhesively attached to the metal jacket.

7 Claims, 1 Drawing Sheet

THERMAL INSULATION JACKET FOR A GUN BARREL

BACKGROUND OF THE INVENTION

The invention concerns a thermal insulation jacket for a gun barrel, especially a cannon barrel, where the thermal insulation jacket consists of a metal jacket that surrounds the gun barrel.

Gun barrels, especially long, slender cannon barrels, undergo bending when temperature differences are present on the surface, and this can result in loss of firing accuracy. Temperature differences on the surface can arise, for example, if the sun is shining on one side of the cold gun barrel or a cold wind is blowing against one side of a hot barrel.

To avoid corresponding uneven heating of the gun barrel, it is known, for example, from DE 19 18 422 A, that the gun barrel can be provided with a thermal insulation jacket, which consists basically of a metal jacket that surrounds the gun barrel with a slight amount of separation from it. The static layer of air between the barrel and the metal jacket serves as a heat insulator.

However, as has been discovered, air convection develops between the surface of the barrel and the metal jacket in a gun barrel that is fired hot, and this air convection causes the underside of the gun barrel to cool more strongly than the upper side of the barrel. These temperature differences lead to undesired barrel distortion, which requires complicated compensation by the gun crew operating the gun.

SUMMARY OF THE INVENTION

The object of the present invention is to provide a thermal insulation jacket for gun barrels, with which uneven heating of the surface of the gun barrel within the thermal insulation jacket can be avoided in a simple and economical way.

The invention is based essentially on the idea of providing an additional area that is especially effective at reflecting thermal radiation on the inner surface of the metal jacket that lies opposite the underside of the gun barrel, so that when the gun barrel heats, the temperature differences between the upper side and the underside of the gun barrel are at least partially compensated.

To this end, a reflective film that is a good reflector of infrared light is adhesively attached to the metal jacket on the inner surface of the metal jacket that lies opposite the underside of the gun barrel. The film preferably has a reflectivity in the IR range (blackbody at about 293 K) of ≧80%.

The film-coated region of the barrel's thermal insulation jacket depends on various boundary conditions. It is especially advantageous or sufficient if the entire lower half of the thermal insulation jacket is covered with the film.

Gun barrels that already have conventional thermal insulation jackets can be easily retrofitted. To accomplish this, it is only necessary that the reflective films be adhesively applied to the lower half of the existing metal jackets.

It was found to be especially advantageous if the reflective films are plastic-coated aluminum films. Films of this type not only have good reflective properties in the infrared range but also good adhesive properties and processing properties as well as properties that enable them to withstand environmental influences. PVC coatings have proven effective. However, it is also possible to use polyethylene or polypropylene coatings, which have low absorption in the IR range.

Gold and aluminum are favored as preferred materials for the reflective film, but other metals are also possible.

Further details and advantages of the invention are disclosed by the specific embodiments explained below with reference to the drawings.

DETAILED DESCRIPTION OF THE INVENTION

Figure 1:
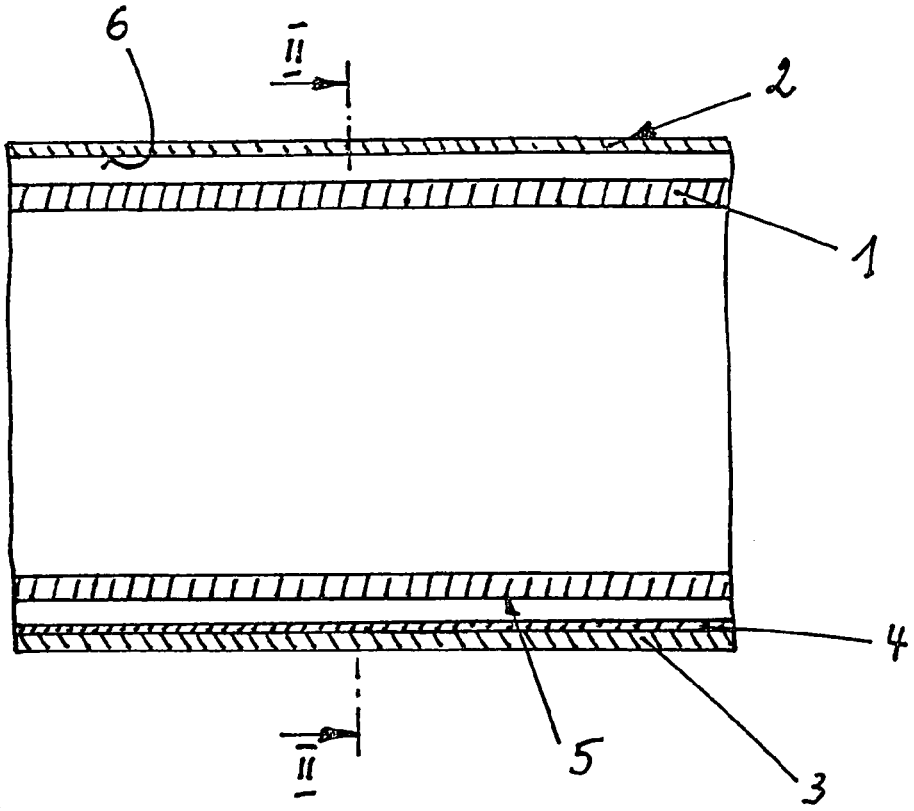
FIG. 1 shows a longitudinal section of a portion of a cannon barrel with a thermal insulation jacket in accordance with the invention.
Figure 2:
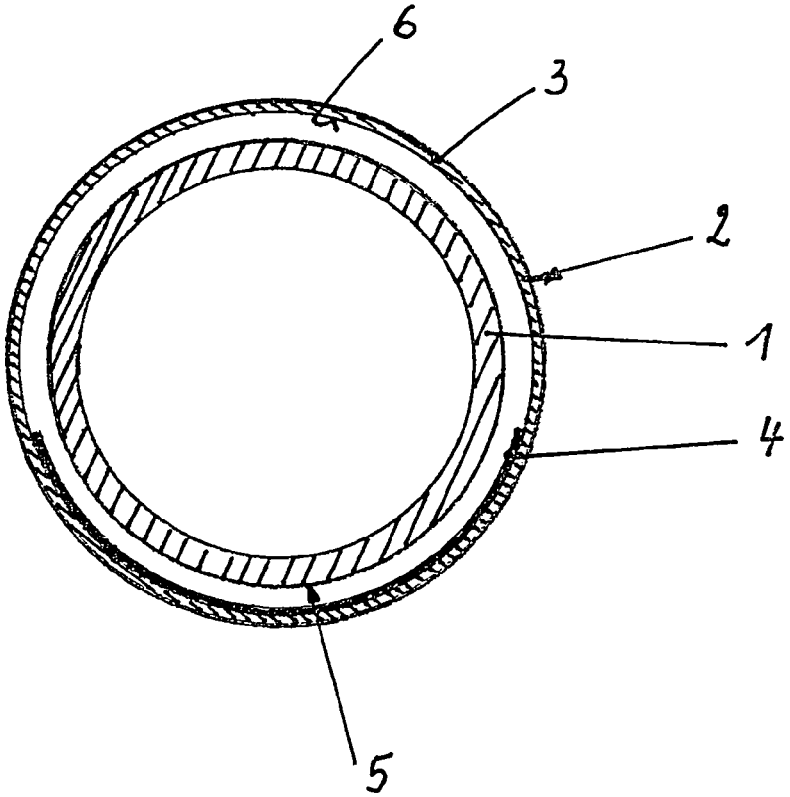
FIG. 2 shows a cross section through the arrangement illustrated in FIG. 1 along section line II-II in FIG. 1.

In FIGS. 1 and 2, a large-caliber cannon barrel 1 of a tank is surrounded by a thermal insulation jacket 2 in a way that in itself is already well known. The inventive thermal insulation jacket 2 includes a metal jacket 3 (e.g., of aluminum) and a reflective film 4 that is a good reflector of thermal radiation.

The reflective film 4 is a plastic-coated aluminum film, which is applied only on the inner surface 6 of the metal jacket 3 that faces the underside 5 of the cannon barrel 1 and is adhesively bonded with the metal jacket 3.

If the cannon barrel 1 is now used as intended, it starts to heat according to the rate of fire. The thermal radiation (IR radiation) given off as it heats is partially reflected by the thermal insulation jacket 2 and returns to the outer surface of the cannon barrel 1. Since more thermal radiation is reflected by the reflective film 4 than by the remaining surface of the metal jacket 3, the lesser heating of the underside 5 of the cannon barrel 1 due to air convection is compensated.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A thermal insulation jacket for a gun barrel, comprising:

a single layer metal jacket configured to surround the gun barrel; and a reflective film that is a reflector of infrared light adhesively attached only to a region of the metal jacket on an inner surface of the metal jacket that faces an underside of the gun barrel, wherein the reflective film is a plastic-coated aluminum film.

2. The thermal insulation jacket in accordance with claim 1, wherein the fact that the reflective film is a plastic-coated gold film.

3. The thermal insulation jacket in accordance with claim 1, wherein the film has a reflectivity in an IR range (blackbody at about 293 K) of 80%.

4. The thermal insulation jacket in accordance with claim 1 wherein the plastic coating is PVC, polyethylene, or polypropylene.

5. The thermal insulation jacket in accordance with claim 1, wherein the film-coated region of the metal jacket is based on various boundary conditions.

6. The thermal insulation jacket in accordance with claim 5, wherein an entire lower half of the metal jacket is covered with the film.

7. A gun, comprising:

a gun barrel;

a thermal insulation, single layer metal jacket configured to surround the gun barrel; and a reflective film that is a reflector of infrared light adhesively attached only to a region of the metal jacket on an inner surface of the metal jacket that faces an underside of the gun barrel.

* * * * *